US007762538B2

(12) United States Patent
Kinne et al.

(10) Patent No.: US 7,762,538 B2
(45) Date of Patent: Jul. 27, 2010

(54) GATHERER STITCHER WITH VARIABLE CHAIN PITCH AND METHOD FOR ADAPTING AN ENDLESS GATHERER CHAIN TO A FORMAT OF A PRODUCT

(75) Inventors: Klaus Kinne, Leipzig (DE); Torsten Brünner, Zweenfurth (DE); Siegmar Tischer, Borsdorf (DE); Lutz Richter, Schkeuditz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 279 days.

(21) Appl. No.: 11/952,269

(22) Filed: Dec. 7, 2007

(65) Prior Publication Data

US 2008/0136082 A1 Jun. 12, 2008

(30) Foreign Application Priority Data

Dec. 7, 2006 (DE) ..... 10 2006 057 681

(51) Int. Cl.
*B65H 37/04* (2006.01)

(52) U.S. Cl. ..... 270/52.29; 270/52.14; 270/52.16; 270/52.18; 270/52.26

(58) Field of Classification Search ..... 270/52.14, 270/52.16, 52.18, 52.19, 52.26, 52.29
See application file for complete search history.

(56) References Cited

U.S. PATENT DOCUMENTS

| | | | | |
|---|---|---|---|---|
| 1,348,849 | A | 8/1920 | Christensen | |
| 3,807,547 | A * | 4/1974 | Mueller | 198/644 |
| 4,770,284 | A | 9/1988 | Boss | |
| 4,789,147 | A * | 12/1988 | Berger et al. | 270/1.03 |
| 5,667,212 | A * | 9/1997 | Merkli | 270/52.16 |
| 6,315,107 | B1 | 11/2001 | Muller et al. | |
| 7,281,706 | B2 * | 10/2007 | Kinne et al. | 270/52.16 |
| 2005/0158150 | A1 * | 7/2005 | Kinne et al. | 412/1 |
| 2007/0108687 | A1 * | 5/2007 | Doucet | 270/52.26 |

FOREIGN PATENT DOCUMENTS

| | | | |
|---|---|---|---|
| DE | 3602319 | A1 | 9/1986 |
| EP | 0881180 | B1 | 12/1998 |
| EP | 0916514 | B1 | 5/1999 |
| EP | 1074495 | A1 | 2/2001 |
| EP | 1566284 | A2 | 8/2005 |
| GB | 688375 | A | 3/1953 |
| JP | 2001-72280 | A | 3/2001 |

OTHER PUBLICATIONS

European Search Report dated May 15, 2009.

* cited by examiner

*Primary Examiner*—Gene Crawford
*Assistant Examiner*—Leslie A Nicholson, III
(74) *Attorney, Agent, or Firm*—Laurence A. Greenberg; Werner H. Stemer; Ralph E. Locher

(57) ABSTRACT

A gatherer stitcher includes an endless gatherer chain for gathering and transporting folded sheets astride the chain. The gatherer chain has chain roof segments and driving elements being adjustable in position. In an inactive position, a driving element that can be folded forms part of the roof of the gatherer chain and, in another, active position, projects out of the roof of the gatherer chain transversely relative to the conveying direction. The driving element can be driven by a control device. A method for adapting the endless gatherer chain to a format of a product is also provided.

16 Claims, 4 Drawing Sheets

GATHERER STITCHER WITH VARIABLE CHAIN PITCH AND METHOD FOR ADAPTING AN ENDLESS GATHERER CHAIN TO A FORMAT OF A PRODUCT

CROSS-REFERENCE TO RELATED APPLICATION

This application claims the priority, under 35 U.S.C. §119, of German Patent Application DE 10 2006 057 681.0, filed Dec. 7, 2006; the prior application is herewith incorporated by reference in its entirety.

BACKGROUND OF THE INVENTION

Field of the Invention

The invention relates to a gatherer stitcher having an endless gatherer chain to which chain roof segments are fixed and together form a chain roof for the gathering and transport of folded sheets astride the chain roof. The gatherer chain has driving elements with an adjustable position. The invention also relates to a method for adapting the endless chain to a format of a product.

Generic gatherer stitchers are known. Individual folded sheets from a stack are separated, opened and deposited on the gatherer chain by folded sheet feeders. The gatherer chain has a guide device with an upper section which is constructed in the form of a knife edge and has a ridge line that defines a transport and stitching line, as well as a substantially roof-like support on which the folded sheets are transported astride. In order to reliably grip the folded sheets deposited on the gatherer chain even at high processing speed and to achieve secure driving and transport them uniformly, the gatherer chain has driving elements, which convey the deposited folded sheets in the horizontal direction. The folded sheets conveyed by the gatherer chain and the driving devices are transported by the gatherer chain as far as a stitching station, in which folded sheets lying on one another at the fold are stitched with the aid of a wire staple. For that purpose, use is made of stitching heads disposed above the gatherer chain as well as clincher boxes disposed underneath the gatherer chain, which bend over free ends of the wire staples stuck through the folded sheets by the stitching heads. Subsequently, in the delivery region, the stitched folded sheets are conveyed further by the gatherer chain for further processing. Trimming and delivery, for example, follow.

A distinction should be drawn between gatherer stitchers having a one-piece and a two-piece gatherer chain. In the case of gatherer stitchers having two-piece gatherer chains, two roller chains are disposed in parallel. One gatherer chain half performs the function of the main gatherer chain and the other gatherer chain half performs the function of the secondary gatherer chain. The saddle-like chain roof is formed from chain roof segments, which are fitted to roller chains located on the right and left in the conveying direction. European Patent EP 0 916 514 B1, for example, discloses a two-piece gatherer chain, in which the secondary gatherer chain extends only in the region of the feeder until before the stitching station, and the main gatherer chain extends along the entire transport and stitching line beyond the stitching station. A gatherer chain configured in that way permits improved accessibility in the region of the stitching station for mounting and adjustment work, and therefore a higher stitching quality.

European Patent EP 881 180 B1, corresponding to U.S. Pat. No. 6,315,107, shows a gatherer stitcher having a one-piece gatherer chain. The chain roof includes chain roof segments which are fitted to a roller chain. The driving elements are disposed fixedly on the ridge of the gatherer chain, which means that the gatherer chain can be constructed to be particularly narrow. However, that accepts the disadvantage that supporting blades disposed above the ridge on the feeders must have an appropriate spacing.

One embodiment which combats that disadvantage is disclosed in European Patent Application EP 1 074 495 A1, corresponding to Patent Abstracts of Japan JP 2001 072280 A. In that case, the driving elements are fixed to the gatherer chain in such a way that they can move, so that they can be pivoted from a position projecting substantially laterally to a position projecting substantially upward. As a result of the position change, space needed for devices fitted peripherally, for example inkjet devices, is created and in that way the driving elements do not hinder the processing of the product. Moreover, in that case the driving elements fulfill their function and guide the product on the legs or webs of the folded sheet. Following the processing station, there are restrictions arising from the pivoted driving devices. For example, the product cannot be stitched directly afterwards or checked for completeness, for example through the use of ridge thickness measurement. Before that, the driving devices again have to be pivoted into their position substantially projecting laterally.

The productivity of a gatherer stitcher does not depend only on the operating speed but instead also on how many products can be processed by the machine in a specific time. In order to increase the number of products per unit time and therefore the productivity of the gatherer stitcher without increasing the speed of the gatherer chain, the chain pitch is adapted to the product format. This means that the spacing between the driving devices on the gatherer chain is changed. Since, in the case of relatively small products, a small spacing between the driving devices on the gatherer chain is sufficient, through the use of an appropriate reduction in the size of this spacing, more products can be deposited on the gatherer chain per unit time, which increases the productivity.

The prior art discloses various approaches to a device for changing the chain pitch. For example, driving elements can be fitted to outer chain plates of roller chains through the use of screw fixing, for example, and can be removed again simply. Alternatively, driving elements can be fitted to outer chain plates of the roller chain without tools through the use of clamp connections.

In a further variant, the driving elements can be configured as plastic pins, which are plugged into saddle segments of the gatherer chain that are provided with accommodating holes.

The problem with those approaches to a device is that the manual changing of the chain pitch is complicated and time-consuming. The necessary stoppage time for the adaptation of the machine to the product format in turn causes lower productivity.

A further problem with the use of gatherer stitchers according to the prior art exists in the region of the delivery of the stitching machine. A blade moving from below into the folded and stitched edge throws the stitched product out through the use of a vertical movement. At the same instant, however, the product is still being transported onward in the horizontal direction by the driving devices. The superimposition of vertical and horizontal movement of the product can lead to markings or ink deposits on the inside of the product as a result of the driving devices moving underneath.

BRIEF SUMMARY OF THE INVENTION

It is accordingly an object of the invention to provide a gatherer stitcher with a variable chain pitch and a method for adapting an endless gatherer chain to a format of a product, which overcome the hereinafore-mentioned disadvantages of the heretofore-known devices and methods of this general type and in which the gatherer stitcher can be used more flexibly, permits higher productivity and at the same time ensures a higher product quality.

With the foregoing and other objects in view there is provided, in accordance with the invention, a gatherer stitcher, comprising an endless gatherer chain. The gatherer chain has fixed chain roof segments together forming a chain roof for gathering and transporting folded sheets astride the chain roof. The gatherer chain also has driving elements adjustable between an inactive position forming part of the chain roof of the gatherer chain and another, active position, projecting out of the chain roof of the gatherer chain transversely relative to a conveying direction of the gatherer chain.

As mentioned above, the gatherer chain of a gatherer stitcher according to the invention has chain roof segments and driving elements, and the position of the driving elements are adjustable. Thus, in an inactive position, the driving elements form part of the chain roof of the gatherer chain and, in an active position, they project out of the chain roof of the gatherer chain transversely with respect to the conveying direction and fulfill the function of a driving device. In this case, the gatherer chain itself can be constructed in one piece or two pieces. In an advantageous embodiment, the driving element is configured in such a way that it can be folded and can be driven by a control device. The control device includes a drive device and a control mechanism, with the drive device being stationary or displaceable and the control mechanism being moved as part of the gatherer chain. The drive device acts on the control mechanism, by which the position of each driving element can be adjusted individually, which is to say the driving element can be activated or deactivated. The control mechanism has a control lever, compression springs, pivoting levers with knife edges and knife edge bearings. In the case of a knife edge bearing, the knife edge of a body rolls in a pan-like opposing body of greater hardness and permits a swinging movement of the body.

In a particularly advantageous embodiment, the driving devices seated on the gatherer chain on the right and left in the conveying direction are driven individually. If, on one side of the gatherer chain, there is, for example, an inkjet device for printing products or a label dispenser for affixing labels, it is advantageous to fold the driving elements in completely in the processing region. The driving elements are thus inserted into the driving chain roof, form part of the supporting surface of the chain roof and in no way hinder inline processing. To this end, before the processing station there is a drive device which folds the driving element in, that is to say deactivates it and, after the processing station, a further drive device which folds the driving element out and activates it again.

In a further advantageous embodiment of the invention, a drive device is also fitted in the delivery region. The controllable driving device ensures exact positioning of the product with respect to the delivery center which depends on the format, that is to say on the spine length of the product, through the use of a variable time at which the contact of the driving element with the limb or web of the folded sheet is cancelled. The necessary drive device can be implemented, for example, through the use of a displaceable control cam acting on the control mechanism. In order to adapt the chain pitch on the gatherer chain to the product format to be processed, and therefore to increase the productivity of the gatherer stitcher, the driving elements are fitted to the gatherer chain at defined distances. The distances are dimensioned in such a way that, through the use of folding in and out, familiar formats, such as the German Standards DIN A4, DIN A3, legal, letter, tabloid or other special formats, can be implemented.

With the objects of the invention in view, there is concomitantly provided a method for adapting an endless gatherer chain of a gatherer stitcher to a format of a product to be processed. The method comprises:

a) determining the sheet format;
b) continuously moving the gatherer chain in the conveying direction;
c) individually driving individual drive devices for driving the driving elements;
d) adjusting each of the driving elements with a respective one of the drive devices through a respective control device; and
e) repeating steps step c) and d) until the gatherer chain has been entirely adapted to the product format to be processed.

Other features which are considered as characteristic for the invention are set forth in the appended claims.

Although the invention is illustrated and described herein as embodied in a gatherer stitcher with a variable chain pitch and a method for adapting an endless gatherer chain to a format of a product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
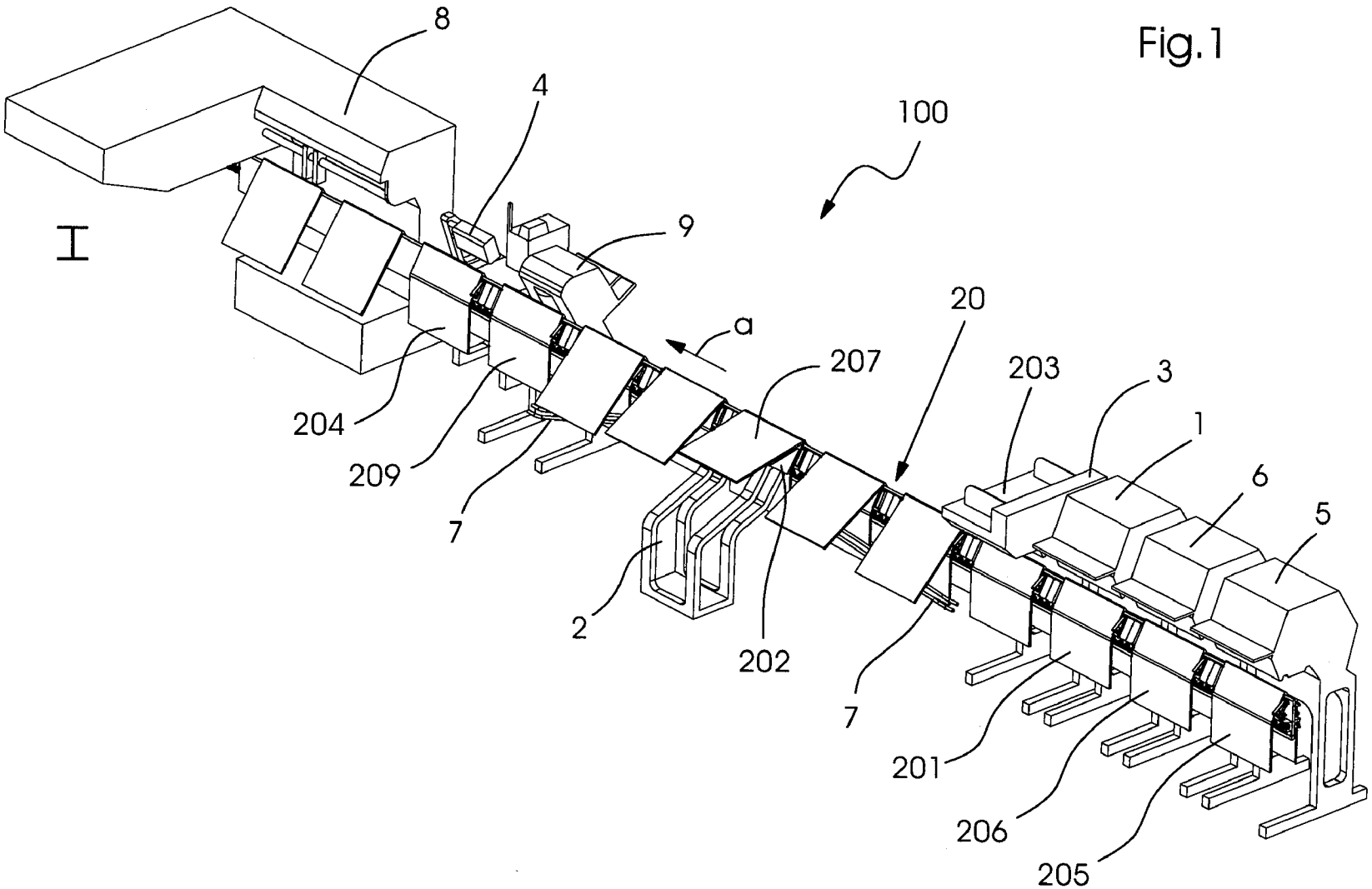
FIG. 1 is a diagrammatic, perspective view of a gatherer stitcher according to the invention.

Referring now to the figures of the drawings in detail and first, particularly, to FIG. 1 thereof, there is seen a gatherer or gang stitcher 100 for collating folded sheets 201-209 to form brochures, which are stitched in a stitching station 8.

A first feeder 5, which is located at the start of a gathering section, deposits a separated folded sheet 205 on a gatherer chain or raceway 20. The feeder is a drum feeder according to the prior art. The folded sheet 205 is transported onward in a conveying direction a through the use of the gatherer chain 20, which has driving or pushing elements 24 (not designated in FIG. 1). A second feeder 6 deposits a second separated folded sheet 206 on the folded sheet 205 provided by the first feeder 5, and a third feeder 1 subsequently deposits a further separated folded sheet 201 on the gatherer chain 20.

Depending on the number of folded sheets which form the brochure, even further feeders, which are not illustrated in FIG. 1, can follow. The last feeder in the conveying direction a is a cover folder feeder 3, which folds a sheet 203 and deposits it on the sheets already gathered.

The brochure, which is completed to this extent, is transported onward by the gatherer chain 20 in the conveying direction a as far as the stitching station 8. There, the brochure is stitched in a known manner by stitching heads that are not designated in FIG. 1. Directly following the stitching station 8 is a region of a delivery of the gatherer stitcher 100. The delivery region is shown in more detail in FIG. 4.

A trimmer and a delivery, which are not illustrated in FIG. 1, are disposed at a position I and usually at right angles to the gathering section. In this case, a trimmer or a three-side cutter with or without multiple blank separation, can be used. The delivery can be configured as a criss-cross delivery or a small pack delivery.

FIG. 1 also shows various stations 2, 4, 7, 9 for the inline processing of the folded sheets located on the gatherer chain 20.

One half of an uppermost folded sheet 207 is raised into a virtually horizontal position during the conveying movement in the conveying direction a through the use of a device 7. In this way, an inkjet device 2 is able to print the folded sheet 207 on its inside and the folded sheet 202 located underneath it. In order to ensure that the driving element 24 (not designated in FIG. 1) guiding the folded sheet 202 does not collide with the inkjet device 2, it is folded in before this inline processing station. Since the inkjet device 2 is located on the left of the gatherer chain 20 in the conveying direction a, it is sufficient to fold in the driving element 24 (not designated in FIG. 1) located on the left of the gatherer chain 20 in the conveying direction a. The device 7 can equally well be located on the right of the gatherer chain 20 in the conveying direction a. Then, the driving element 24 located on the right of the gatherer chain 20 in the conveying direction a would have to be folded in. The way in which the driving element is folded in will be described in more detail with regard to FIG. 3. If a folded sheet 204 is to be printed directly on its upper side by an inkjet device 4 in its position on the gatherer chain 20, then the driving element 24 (not designated in FIG. 1) has to be folded in before the processing station in order to avoid a collision between the driving element 24 and the inkjet device 4.

Furthermore, the gatherer stitcher 100 has a dispensing device 9 for applying further products to the folded sheet 209. This can be a label dispenser, product sample sticker, card dispenser or the like. In order to ensure that the driving element 24 (not designated in FIG. 1) which is located on the right of the gatherer chain 20 in the conveying direction a and which transports the gathered folded sheets along the dispensing device 9, does not collide with the dispensing device 9, the same driving element 24 (not designated in FIG. 1) must have been folded in previously.

The inkjet device 4 and the dispensing device 9 are disposed after the cover folder feeder 3 in the conveying direction a in the exemplary embodiment of FIG. 1 and are used for processing the cover. The inkjet device 4 and the dispensing device 9 can equally well be disposed at any other desired positions along the gathering section.

Figure 2:
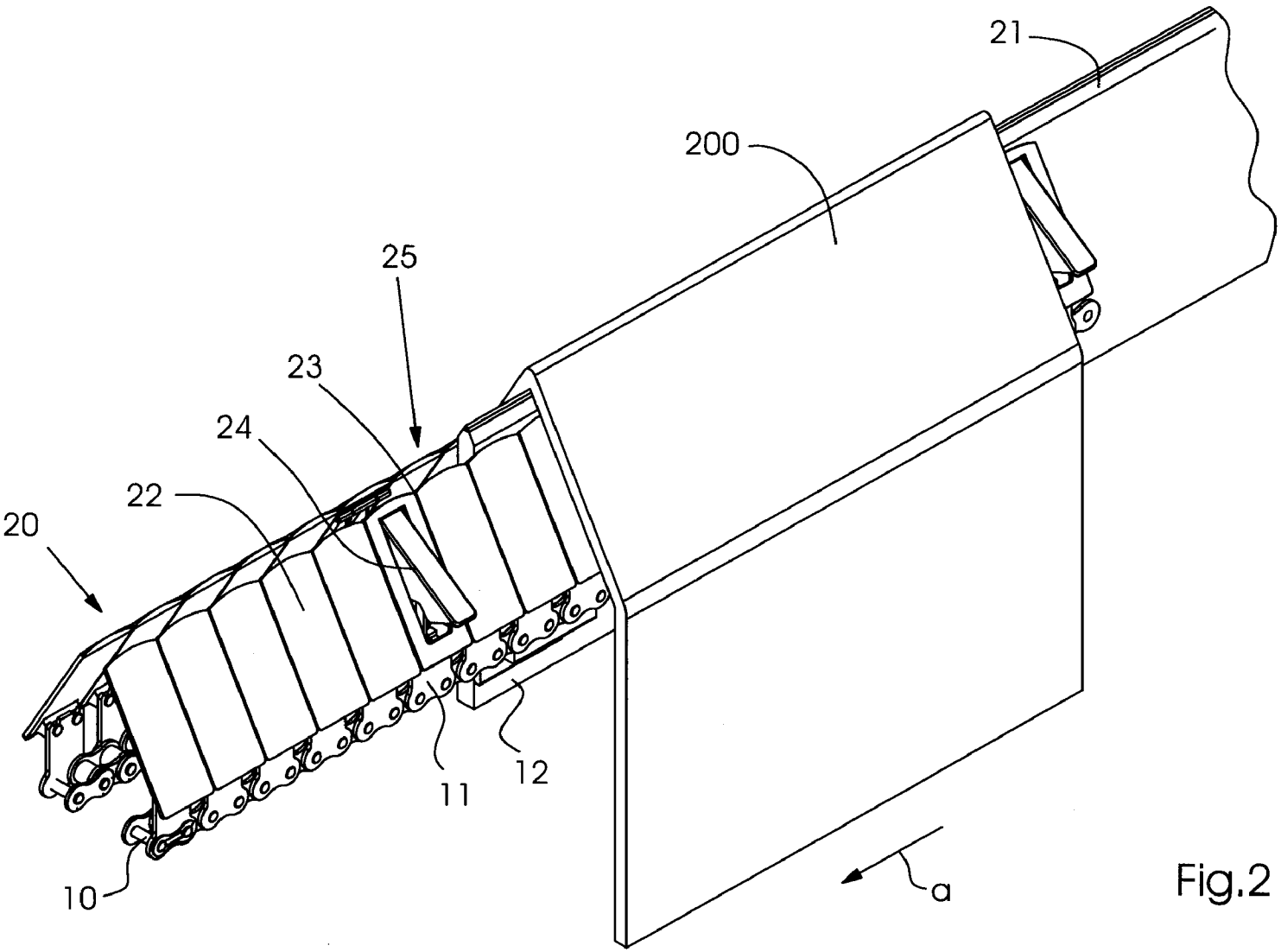
FIG. 2 is an enlarged, fragmentary, perspective view of a gatherer chain having folding driving elements.

FIG. 2 shows a product 200, which is resting astride a chain roof 25 of a gatherer chain 20 and is gripped on its rear legs or webs by the driving element 24 in each case. The driving element 24 in this case projects out of a driving chain roof 23. A folded edge of the product 200 is guided by a knife edge of a guide plate 21. Chain roof segments 22, which are fixed to curved outer chain plates 11 of the roller chain 10, form a supporting surface as the chain roof 25. Furthermore, FIG. 2 shows a roller chain guide 12 of the roller chain 10.

Figure 3:
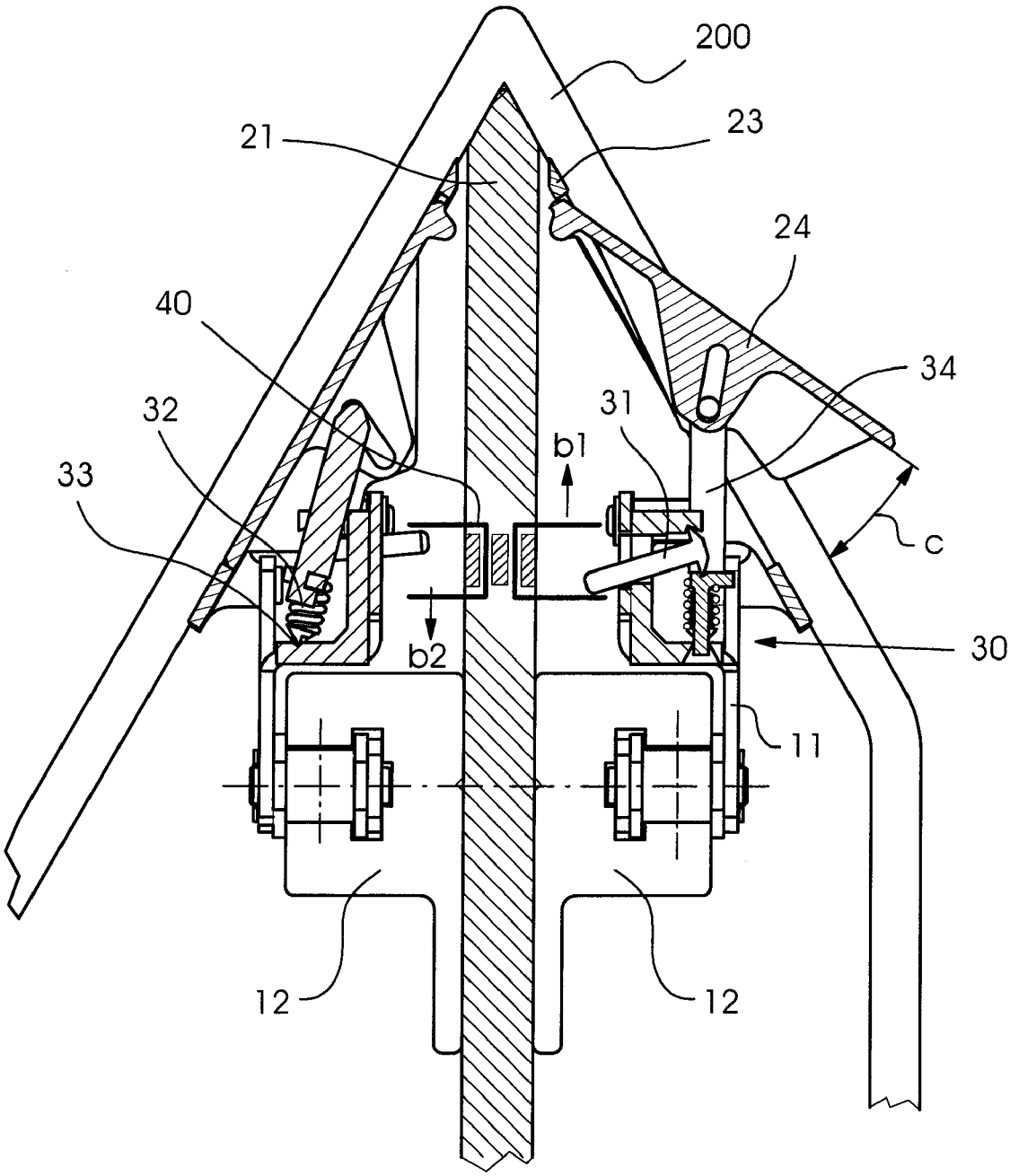
FIG. 3 is a further enlarged, fragmentary, cross-sectional view of the gatherer chain and a control device.

The cross-sectional illustration in FIG. 3 reveals the positions of the driving element 24 and the functioning of a control device. The right half of the figure shows the driving element 24 in an active folded-out state, while the left half of the figure shows the driving element 24 in an inactive folded-in state. A drive device 40 is adjusted along adjustment directions b1 and b2 thereof and has three positions: an upper position, a lower position and a central position. In the central position, the drive device 40 and a control lever 31 do not touch. In order to fold in the driving element 24, the drive device 40 is adjusted upward from its central position in an adjustment direction b1, as is illustrated in the right half of the figure. In order to fold out the driving element 24, the drive device 40 is adjusted downward from its central position in the adjustment direction b2, as is illustrated in the left half of the figure. During the adjustment operation, the drive device 40 exerts a vertical force on the control lever 31. The effect of this is that the control lever 31 is pivoted counter to a spring force of a compression spring 32. A knife edge bearing 33 is coupled with the control lever 31 in such a way that a position of a pivoting lever 34, mounted on its knife edge on the knife edge bearing 33, is changed by a folding angle c as a result of the ability of the pivoting angle of the pivoting lever 34 to be changed. The change of position of the pivoting lever 34 causes a change of position of the driving element 24.

Figure 4:
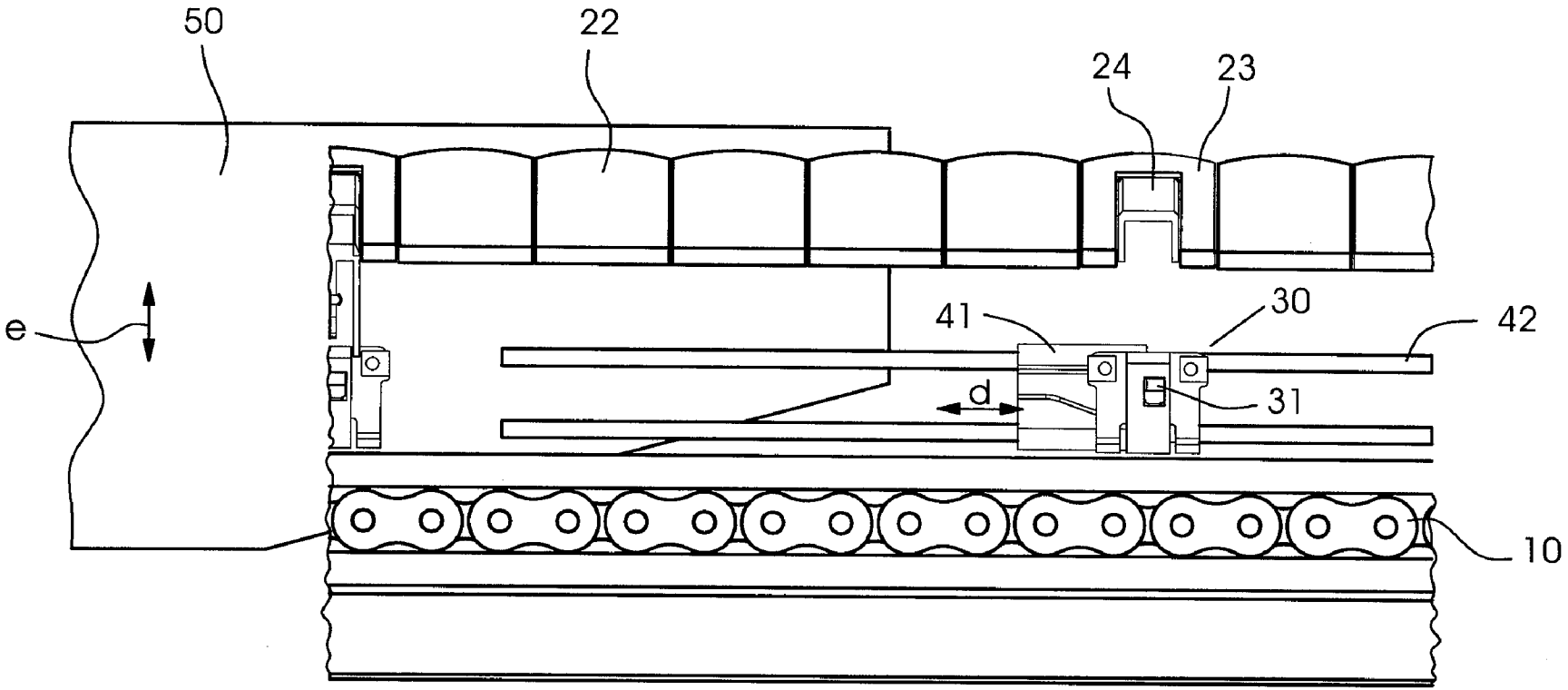
FIG. 4 is a fragmentary, partly-sectional view of a control cam that can be displaced as a function of a format in a delivery.

FIG. 4 is a fragmentary view of a region of the delivery of the gatherer stitcher 100. A control mechanism 30 is actuated in this case by a control cam 41. The control cam 41 can be displaced along guide rails 42 in an adjustment direction d relative to a position of a delivery blade 50 as a function of the sheet format. An ejection movement of the delivery blade 50 is indicated by an arrow e.

The invention claimed is:

1. A gatherer stitcher, comprising:

an endless gatherer chain;

said gatherer chain having fixed chain roof segments together forming a chain roof for gathering and transporting folded sheets astride said chain roof, said chain roof having a supporting surface for supporting the folded sheets; and said gatherer chain having driving elements each being adjustable between an inactive position inserted into a respective said chain roof segment for forming part of said supporting surface of said chain roof of said gatherer chain and another, active position, projecting out of said respective chain roof segment of said gatherer chain transversely relative to a conveying direction of said gatherer chain.

2. The gatherer stitcher according to claim 1, wherein said gatherer chain is constructed in two pieces.

3. The gatherer stitcher according to claim 1, wherein said driving element is configured to be folded.

4. The gatherer stitcher according to claim 1, which further comprises at least one control device for driving said driving elements.

5. The gatherer stitcher according to claim 4, wherein said at least one control device includes a drive device and a control mechanism.

6. The gatherer stitcher according to claim 5, wherein said control mechanism has a control lever, a compression spring, a knife edge bearing and a pivoting lever having a knife edge.

7. The gatherer stitcher according to claim 6, wherein said control lever is pivotable counter to a spring force of said compression spring, said knife edge bearing is coupled with said control lever, said knife edge of said pivoting lever is mounted on said knife edge bearing, and said position of said driving element is changed by changing a pivoting angle of said pivoting lever.

8. The gatherer stitcher according to claim 5, which further comprises a stitching station, a delivery region downstream of said stitching station, and a control cam in said delivery region.

9. The gatherer stitcher according to claim 8, wherein said control cam is displaceable.

10. The gatherer stitcher according to claim 4, wherein said at least one control device includes at least one control mechanism and a drive device controlled by said at least one control mechanism for individually activating and deactivating each of said driving elements.

11. The gatherer stitcher according to claim 1, wherein said driving elements are seated on a right and a left side of said gatherer chain and are driven together in said conveying direction.

12. The gatherer stitcher according to claim 1, wherein said driving elements are seated on a right and a left side of said gatherer chain and are driven individually in said conveying direction.

13. The gatherer stitcher according to claim 12, which further comprises a gathering section, an inkjet device fitted to one side of said gathering section for printing products, and a drive device located before and/or after said inkjet device in said conveying direction.

14. The gatherer stitcher according to claim 12, which further comprises a gathering section, a dispensing device fitted to one side of said gathering section, and a drive device located before and/or after said dispensing device in said conveying direction.

15. The gatherer stitcher according to claim 1, wherein said driving elements are fitted to said gatherer chain as a function of a format of the folded sheets.

16. A method for adapting an endless gatherer chain of a gatherer stitcher to a format of a product to be processed, the method comprising the following steps:

providing an endless gatherer chain, the gatherer chain having fixed chain roof segments together forming a chain roof for gathering and transporting folded sheets astride the chain roof, and the gatherer chain having driving elements adjustable between an inactive position forming part of the chain roof of the gatherer chain and another, active position, projecting out of the chain roof of the gatherer chain transversely relative to a conveying direction of the gatherer chain;

a) determining the sheet format;

b) continuously moving the gatherer chain in the conveying direction;

c) providing and individually driving drive devices for driving the driving elements;

d) providing control devices and adjusting each of the driving elements with a respective one of the drive devices through a respective one of the control devices; and e) repeating the steps of driving the drive devices in step c) and adjusting the driving elements in step d) until the gatherer chain has been entirely adapted to the product format to be processed.

* * * * *